US011641873B2

(12) United States Patent
Miyashita

(10) Patent No.: US 11,641,873 B2
(45) Date of Patent: May 9, 2023

(54) TOW BAND FOR HEATED TOBACCO PRODUCT TIP, TIP FOR HEATED TOBACCO PRODUCT, METHOD FOR MANUFACTURING TOW BAND FOR HEATED TOBACCO PRODUCT TIP, AND METHOD FOR MANUFACTURING HEATED TOBACCO PRODUCT TIP

(71) Applicant: DAICEL CORPORATION, Osaka (JP)

(72) Inventor: Tomoharu Miyashita, Tokyo (JP)

(73) Assignee: DAICEL CORPORATION, Osaka (JP)

( * ) Notice: Subject to any disclaimer, the term of this patent is extended or adjusted under 35 U.S.C. 154(b) by 0 days.

(21) Appl. No.: 16/467,855

(22) PCT Filed: Oct. 25, 2018

(86) PCT No.: PCT/JP2018/039654
§ 371 (c)(1),
(2) Date: Jun. 7, 2019

(87) PCT Pub. No.: WO2020/084732
PCT Pub. Date: Apr. 30, 2020

(65) Prior Publication Data

US 2021/0251282 A1 Aug. 19, 2021

(51) Int. Cl.
*A24D 3/10* (2006.01)
*A24D 3/02* (2006.01)
*D02G 1/12* (2006.01)

(52) U.S. Cl.
CPC ..... *A24D 3/10* (2013.01); *A24D 3/0204* (2013.01); *D02G 1/125* (2013.01)

(58) Field of Classification Search
None
See application file for complete search history.

(56) References Cited

U.S. PATENT DOCUMENTS 3,120,692 A 2/1964 Crawford et al.
3,361,137 A * 1/1968 Watson ..... A24D 3/0233 493/44

(Continued)

FOREIGN PATENT DOCUMENTS

CN 106690411 A 5/2017
CN 106723334 A 5/2017

(Continued)

OTHER PUBLICATIONS

"Heated Tobacco Products", Centers for Disease Control and Prevention, 5 pages, 2020, [online], retrieved from the internet, [retrieved Mar. 10, 2022], <URL: https://www.cdc.gov/tobacco/basic_information/heated-tobacco-products/index.html>. (Year: 2020).*

(Continued)

*Primary Examiner* — Dennis R Cordray
(74) *Attorney, Agent, or Firm* — Birch, Stewart, Kolasch & Birch, LLP

(57) ABSTRACT

A tow band for heated tobacco product tip is a tow band of cellulose acetate provided by uniting and crimping a plurality of filaments into a bundle, in which a total denier is set to a value in a range of 10000 to 40000 (inclusive) and a filament denier is set to a value in a range of 6.0 to 20.0 (inclusive), and where the total denier is denoted by TD and a breaking strength of the tow band is denoted by F, a ratio F/TD is set to a value of 0.0015N/denier or more.

14 Claims, 4 Drawing Sheets

(56) References Cited

U.S. PATENT DOCUMENTS

| | | | | |
|---|---|---|---|---|
| 3,571,870 | A | 3/1971 | Dixon et al. | |
| 4,503,593 | A | 3/1985 | Floyd et al. | |
| 5,316,827 | A | 5/1994 | Hill et al. | |
| 2004/0237982 | A1 | 12/2004 | Dollhopf et al. | |
| 2007/0028647 | A1 | 2/2007 | Wang et al. | |
| 2013/0112214 | A1* | 5/2013 | Bundren | A24D 3/06 131/280 |
| 2013/0115452 | A1 | 5/2013 | Bundren et al. | |
| 2014/0026909 | A1* | 1/2014 | Sebastian | D02G 1/00 131/332 |
| 2014/0305448 | A1 | 10/2014 | Zuber et al. | |
| 2016/0044958 | A1 | 2/2016 | Sebastian | |
| 2016/0219930 | A1 | 8/2016 | Reed et al. | |
| 2016/0235112 | A1 | 8/2016 | Jung et al. | |
| 2016/0328675 | A1 | 11/2016 | Busby et al. | |
| 2017/0006912 | A1 | 1/2017 | Shibagaki et al. | |
| 2017/0354179 | A1 | 12/2017 | Sebastian et al. | |
| 2019/0075842 | A1* | 3/2019 | Caenen | D01D 5/06 |
| 2020/0397039 | A1* | 12/2020 | Banks | A24D 3/10 |

FOREIGN PATENT DOCUMENTS

| | | | |
|---|---|---|---|
| CN | 106723335 | A | 5/2017 |
| CN | 106723336 | A | 5/2017 |
| CN | 106723337 | A | 5/2017 |
| CN | 106723338 | A | 5/2017 |
| CN | 106723350 | A | 5/2017 |
| CN | 106820259 | A | 6/2017 |
| EP | 3 095 335 | A1 | 11/2016 |
| EP | 3117724 | A1 | 1/2017 |
| EP | 3 821 733 | A1 | 5/2021 |
| JP | 2015-503335 | A | 2/2015 |
| JP | 5888903 | B2 | 3/2016 |
| JP | 2016-533764 | A | 11/2016 |
| JP | 2016-539254 | A | 12/2016 |
| JP | 2018-27881 | A | 2/2018 |
| JP | 2018-35487 | A | 3/2018 |
| JP | 2018-096010 | A | 6/2018 |
| WO | WO 2006/007011 | A2 | 1/2006 |
| WO | WO 2006/007019 | A2 | 1/2006 |
| WO | WO 2013/067503 | A1 | 5/2013 |
| WO | WO 2013/067511 | A2 | 5/2013 |
| WO | WO 2016/084115 | A | 6/2016 |
| WO | WO 2016/084120 | A1 | 6/2016 |
| WO | WO 2019/049086 | A1 | 3/2019 |

OTHER PUBLICATIONS

"About Electronic Cigarettes (E-Cigarettes)", Centers for Disease Control and Prevention, 6 pages, 2021, [online], retrieved from the internet, [retrieved Mar. 10, 2022], <URL https://www.cdc.gov/tobacco/basic_information/e-cigarettes/about-e-cigarettes.html>. (Year: 2021).*

International Search Report (PCT/ISA/210) issued in PCT/JP2018/039654, dated Dec. 18, 2018.

Written Opinion (PCT/ISA/237) issued in PCT/JP2018/039654, dated Dec. 18, 2018.

Cellulose Acetale Filter Tow Specifications, 1992, 1 page total, URL: https://www.industrydocuments.ucsf.edu/docs/trkk0007.

Schultze-Gebhardt et al., "Fibers, 1. Survey," Ullmann's Fibers, vol. 1, 2008, pp. 1-38. 38 pages total.

* cited by examiner

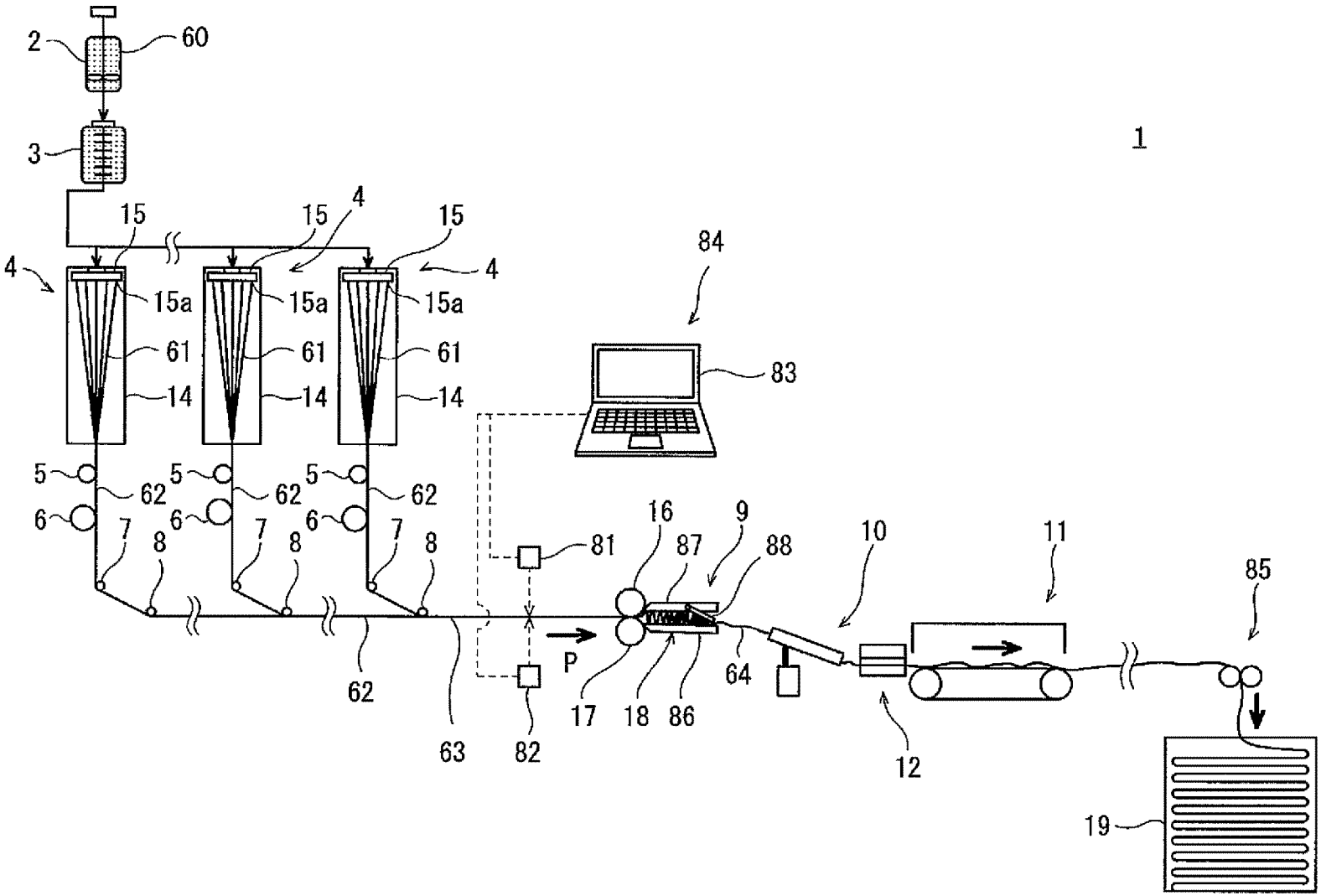
[Fig. 1]

[Fig. 2]
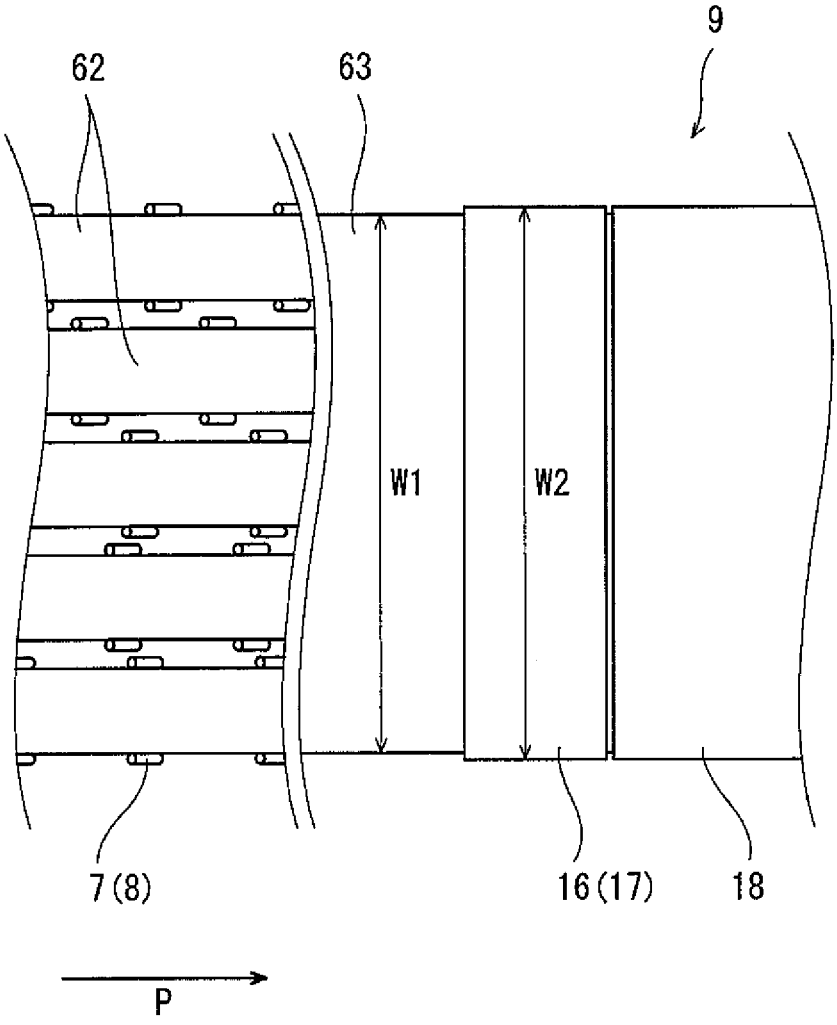

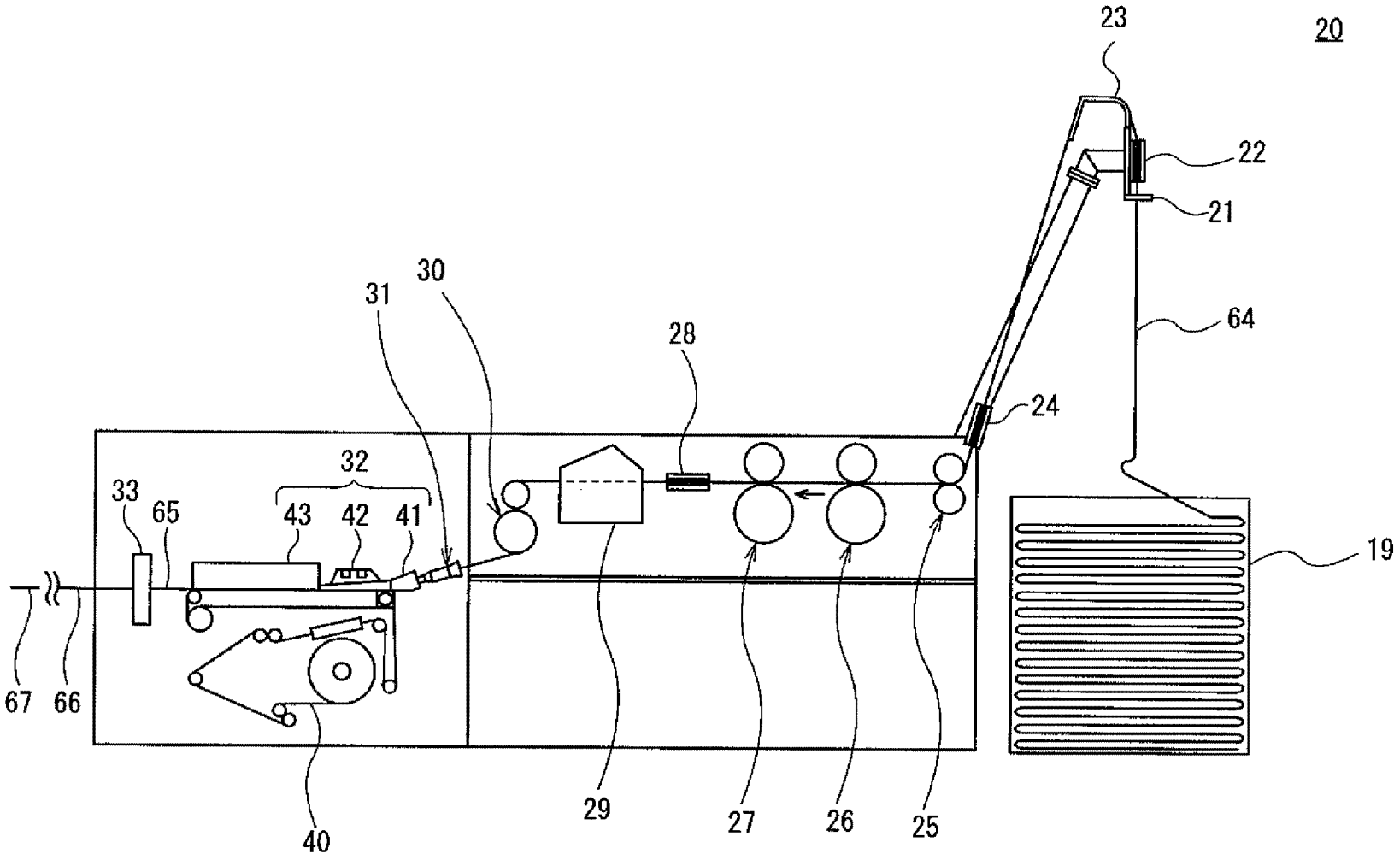
[Fig. 3]

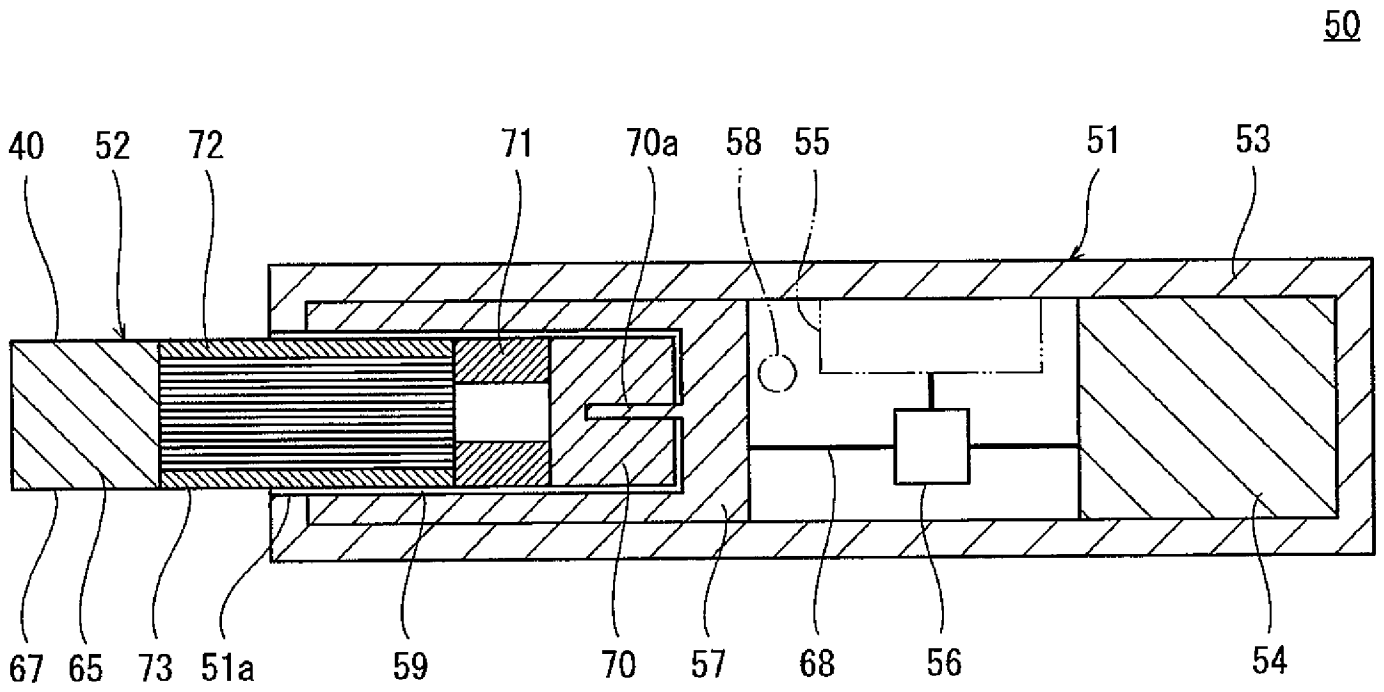
[Fig. 4]

TOW BAND FOR HEATED TOBACCO PRODUCT TIP, TIP FOR HEATED TOBACCO PRODUCT, METHOD FOR MANUFACTURING TOW BAND FOR HEATED TOBACCO PRODUCT TIP, AND METHOD FOR MANUFACTURING HEATED TOBACCO PRODUCT TIP

TECHNICAL FIELD

The present invention relates to a tow band for heated tobacco product tip, a tip for heated tobacco product, a method for manufacturing a tow band for heated tobacco product tip, and a method for manufacturing an heated tobacco product tip.

BACKGROUND ART

In this document, the following defined terms are used.

TD: Total fineness (total denier), which refers to the fineness (grams per 9000 m) of a tow band or a plurality of filaments in one bundle.

FD: Single fineness (filament denier), which refers to the fineness (grams per 9000 m) of a single fiber (one filament). It is also called monofilament denier.

Filament: Referring to a continuous long fiber. In particular, it refers to a single fiber discharged from a spinning hole of a spinneret.

Spinning hole: Formed in a spinneret of a spinning cylinder, and discharging (spinning) a filament.

Tow band: A plurality of yarns each of which is an assembly of filaments (single fibers) discharged from respective spinnerets of a plurality of spinning cylinders, are united and a TD is set to a predetermined value to provide an end. This end is crimped. This crimped end (an assembly of filaments) is called a tow band. That is, the tow band has a TD and the number of crimps. The tow band is packed in a bale shape.

End: Referring to an assembly of filaments united (converged) such that a plurality of filaments discharged from the spinning holes of a plurality of spinning cylinders have a predetermined total denier.

Yarn: Referring to a bundle of filaments discharged from one spinning cylinder. Thus, a yarn is an assembly of filaments before united.

Tip: Referring to a filter that allows tobacco components to pass through when smoking a cigarette or using a heated tobacco product. The tip is configured, for example, by shaping a predetermined air-permeable material into a rod and winding a rolling paper around the outer periphery of the material.

In recent years, the spread of heated tobacco products has progressed. For example, as disclosed in Patent Literature 1, this heated tobacco product includes a base material containing a volatile component that is a tobacco component, a heating unit that heats the base material, a cooling unit that cools and condenses the volatile component from the heated base material to form aerosol, and a tip that filters the aerosol having passed through the cooling unit.

The tip is put into the user's lips when the heated tobacco product is in use. The tip is manufactured using a tow band (hereinafter also simply called a tow band) consisting of a plurality of filaments of crimped long fiber cellulose acetate, for example.

At the time of manufacturing the tip, for example, a crimped and packed bale-like tow band is unrolled from the packaging container, opened while being conveyed, and a plasticizer is attached thereto to be shaped into a rod. A rolling paper is wound around the outer periphery of a shaped body of tow band. The tip is manufactured by cutting the shaped body and the rolling paper into predetermined dimensions.

CITATION LIST

Patent Literature

PTL 1: Japanese Unexamined Patent Application Publication No. 2015-503335

SUMMARY OF INVENTION

Technical Problem

For a tow band used for a tip for heated tobacco product, a tow band having a relatively large FD and a relatively small TD, for example, is used in order to provide the tip with an appropriate PD (airflow resistance) and hardness.

However, at the time of manufacturing the tow band and the tip, an external force is applied to the filament having a relatively large FD, which may cause a filament fragment (hereinafter also called fly) to occur. For example, when a filament fragment is incorporated into a shaped body in a state of absorbing a plasticizer, the filament may be melted to cause a melt hole. This may reduce the manufacturing efficiency and the quality of the tip.

Then, it is an object of the present invention to prevent the manufacturing efficiency and the quality of a tip for heated tobacco product from decreasing due to a fragmentation of a filament when manufacturing the tip for heated tobacco product using a tow band.

Solution to Problem

In order to solve the above problem, a tow band for heated tobacco product tip according to an aspect of the present invention is a tow band of cellulose acetate provided by uniting and crimping a plurality of filaments into a bundle, in which the total denier is set to a value in a range of 10000 to 40000 (inclusive), the filament denier is set to a value in a range of 6.0 to 20.0 (inclusive), and, where the total denier is denoted by TD and the breaking strength is denoted by F, the ratio F/TD is set to a value of 0.0015 N/denier or more.

According to the above configuration, the strength per filament can be improved by setting the ratio F/TD to the above value while setting the TD and FD of the tow band to desired values within the above ranges. As a result, for example, when manufacturing a tow band and a tip using a filament having a relatively large FD, it is possible to prevent a filament from being fragmented even if an external force is applied to the filament. It is hence possible to manufacture well a tip for electronic cigarette. Accordingly, the manufacturing efficiency and the quality of the tip for electronic cigarette can be prevented from decreasing.

The total denier may be set to a value in a range of 20000 to 40000 (inclusive), and the filament denier may be set to a value in a range of 8.0 to 20.0 (inclusive).

The total denier may be set to a value in a range of 10000 to 20000 (inclusive), and the filament denier may be set to a value in a range of 6.0 to 12.0 (inclusive).

A tip for heated tobacco product according to an aspect of the present invention includes a shaped body provided by shaping any of the above-described tow bands into a rod, and a rolling paper wound around the peripheral surface of the shaped body. According to this configuration, it is possible to form a shaped body by the well crimped tow band while preventing a filament from being fragmented. Accordingly, the manufacturing efficiency and the quality of the tip for heated tobacco product can be prevented from decreasing.

A method for manufacturing a tow band for heated tobacco product tip according to an aspect of the present invention includes an aligning step of aligning a plurality of filaments in a roll width direction of a pair of nip rolls at a position preceding the pair of nip rolls in a conveyance direction of the plurality of filaments while conveying the plurality of filaments of which the total denier is set to a value in the range of 10000 to 40000 (inclusive) and the filament denier is set to a value in the range of 6.0 to 20.0 (inclusive); a crimping step of crimping, by the pair of nip rolls, the plurality of filaments having been aligned in the aligning step; and a monitoring step of monitoring a thickness dimension of a filament assembly consisting of the plurality of filaments at at least any of the position preceding the pair of nip rolls and a position subsequent to the pair of nip rolls in the conveyance direction, and in the crimping step, the pair of nip rolls having a ratio TD/D set to 800 denier/mm to 2000 denier/mm (inclusive) is used, where the total denier is denoted by TD and a roll width dimension of the pair of nip rolls is denoted by D.

According to the above method, by monitoring the thickness dimension of the filament assembly in the monitoring step, the aligning step can be performed so that the value of the thickness dimension of the filament assembly falls within a reference range, for example, in a case where the value of the thickness dimension of the filament assembly fluctuates greater than the reference range.

Also, the ratio TD/D is set to 800 deniers/mm to 2000 deniers/mm (inclusive) while the TD and the FD of the tow band are set to desired values within the above range. With the settings, it is possible to manufacture the tow band by uniformly aligning the plurality of filaments in the roll width direction of the pair of nip rolls and crimping the filaments by an external force of appropriate strength.

This can prevent a filament from being fragmented due to an excessive external force applied to the filaments when the filaments are crimped by the pair of nip rolls, for example. By preventing the filament from being fragmented in this manner, the high breaking strength of the filaments can be maintained. For this reason, it is also possible to prevent the filament from being fragmented due to the external force applied to the crimped filament while being conveyed, for example. Therefore, for example, by shaping the tow band into a rod, it is possible to manufacture well the tip for heated tobacco product and it is possible to prevent the manufacturing efficiency and the quality of the tip for heated tobacco product from decreasing.

In the crimping step, the pair of nip rolls of which the ratio TD/D is set to 800 deniers/mm to 1300 deniers/mm (inclusive) may be used.

In the crimping step, the plurality of filaments of which the total denier is set to a value in a range of 20000 to 40000 (inclusive) and the filament denier is set to a value in a range of 8.0 to 20.0 (inclusive) may be crimped.

In the crimping step, the plurality of filaments of which the total denier is set to a value in a range of 10000 to 20000 (inclusive) and the filament denier is set to a value in a range of 6.0 to 12.0 (inclusive) may be crimped.

The method for manufacturing the tip for heated tobacco product according to an aspect of the present invention includes a shaping step of shaping, into a rod, the tow band manufactured by any of the methods for manufacturing described above by adding a plasticizer to the tow band.

According to the above method, it is possible to form a shaped body by the well crimped tow band while preventing the filament from being fragmented. For this reason, it is possible to prevent a melt hole from occurring due to a filament fragment absorbing the plasticizer, for example. Accordingly, the manufacturing efficiency and the quality of the tip for heated tobacco product electronic cigarette can be prevented from decreasing.

Advantageous Effects of Invention

In accordance with each aspect of the present invention, it is possible to prevent the manufacturing efficiency and the quality of a tip for heated tobacco product from decreasing due to a fragmentation of a filament when manufacturing the tip for heated tobacco product using a tow band.

BRIEF DESCRIPTION OF DRAWINGS

FIG. 1 is an overall view of a tow band manufacturing device according to Embodiment 1.

FIG. 2 is a top view of a crimping device of FIG. 1.

FIG. 3 is an overall view of a tip manufacturing device according to Embodiment 1.

FIG. 4 is a sectional view of a heated tobacco product according to Embodiment 1.

DESCRIPTION OF EMBODIMENT

An embodiment of the present invention will be described with reference to the drawings.

Embodiment 1

[Cellulose Acetate Tow Band Manufacturing Device]

FIG. 1 is an overall view of a cellulose acetate (hereinafter also called CA) tow band manufacturing device 1. FIG. 2 is a top view of a crimping device 9 of FIG. 1. The CA tow band manufacturing device 1 shown in FIG. 1 spins a CA filament 61 by a dry spinning method. The CA tow band manufacturing device 1 manufactures a yarn 62, an end 63, and a CA tow band 64 with the CA filament 61.

The CA tow band 64 is a tow band for a heated electronic cigarette tip. In the manufacturing device 1, a plurality of the CA filaments 61 (the CA tow bands 64) of which the TD is set to a value in the range of 10000 to 40000 (inclusive) and the FD is set to a value in the range of 6.0 to 20.0 (inclusive) are manufactured.

The CA tow band 64 is a tow band for a heated tobacco product tip. In the manufacturing device 1, a plurality of the CA filaments 61 (the CA tow bands 64) of which the TD is set to a value in the range of 10000 to 40000 (inclusive) and the FD is set to a value in the range of 6.0 to 20.0 (inclusive) are manufactured.

In the CA tow band manufacturing device 1, a spinning stock solution 60 in which CA flakes such as cellulose diacetate are dissolved in an organic solvent at a predetermined concentration (for example, a weight concentration value in a range of 20 wt % to 30 wt % (inclusive) of the spinning stock solution 60) is used.

The spinning stock solution 60 is mixed by the mixing device 2 and then filtered by the filtration device 3. The spinning stock solution 60 having passed through the filtration device 3 is discharged from a plurality of spinning holes 15*a* of a spinneret 15 provided on a spinning cylinder 14 of the spinning unit 4.

The spinning hole 15*a* is formed into a peripheral shape of a predetermined shape (for example, a circle). The diameter of the spinning hole 15*a* is set as appropriate in accordance with the FD of the CA filament 61 after manufactured. The spinning stock solution 60 discharged from each of the spinning holes 15*a* is heated by hot air supplied from an unillustrated drying unit into the spinning cylinder 14 to evaporate the organic solvent, and thus dried. In this manner, the CA filament 61 that is solid is formed.

As shown in FIG. 1, the plurality of CA filaments 61 having passed through one spinning cylinder 14 are converged by the guide pins 7 and 8 to become the yarn 62. After applied with a fiber oil agent by the oil agent attachment unit 5, the yarn 62 is wound up by the godet roll 6.

A series of units for manufacturing the yarn 62, i.e., the spinning unit 4, which discharges the spinning stock solution 60 from the spinneret 15 to spin the CA filament 61, the drying unit, the oil agent attachment unit 5, and a winding unit having the godet roll 6 is collectively called a station. Usually, a plurality of stations are arranged in a line.

The yarn 62 is pulled off from the peripheral surface of the godet roll 6 by a winding device. As shown in FIG. 2, the yarn 62 having passed through each of the stations is guided by the guide pins 7 and 8 to be conveyed (run side by side) in a conveyance direction P along an alignment direction of the stations, and sequentially accumulated or stacked. In this manner, a plurality of the yarns 62 are converged to form the end 63, which is a flat assembly of the yarns 62. The end 63 is the converged plurality of yarns 62 and is set to a predetermined TD. The end 63 is conveyed and led to the crimping device 9.

As shown in FIG. 1, the crimping device 9 has a pair of nip rolls 16 and 17 and a stuffing box 18. The pair of nip rolls 16 and 17 have rotation axes that are arranged in parallel with each other. The pair of nip rolls 16 and 17 press the end 63 between the peripheral surfaces of each other.

The stuffing box 18 is arranged subsequent to the pair of nip rolls 16 and 17. The stuffing box 18 has a pair of plates 86 and 87 having plate surfaces extending in the conveyance direction P, and a biasing member 88.

The pair of plates 86 and 87 are arranged such that the plate surfaces face each other with a gap therebetween and the gap decreases in the conveyance direction P. The end 63 (the plurality of CA filaments 61) having passed through the pair of nip rolls 16 and 17 is conveyed into the gap.

The end 63 is pressed by the pair of nip rolls 16 and 17 between the pair of nip rolls 16 and 17 and then pushed into the stuffing box 18. The end 63 is pressed by the biasing member 88 towards the plate surface of one of the plate 86 while being conveyed meandering between the plate surfaces of the pair of plates 86 and 87 of the stuffing box 18.

The end 63 is applied with crimping by being pushed into the stuffing box 18 with a force greater than the resistance when the end 63 is pushed into the stuffing box 18 by the pair of nip rolls 16 and 17. In this manner, the CA tow band 64 is obtained.

The CA tow band 64 having passed through the crimping device 9 is guided to the drying device 11 by the guide device 12 while being adjusted to meander in the width direction by the swing device 10. The CA tow band 64 is dried by the drying device 11. The CA tow band 64 having passed through the drying device 11 is transferred to a packaging container 19 by the transfer machine 85, accumulated, compressed, and packed into a bale shape. The packaging container 19 of FIG. 1 shows a cross sectional structure.

The monitoring system 84 monitors the thickness dimension of the filament assembly (here, the end 63 or the CA tow band 64) consisting of the plurality of CA filaments 61, at at least any of a position preceding the pair of nip rolls 16 and 17 and a position subsequent to the pair of nip rolls 16 and 17. The monitoring system 84 of the present embodiment monitors the thickness dimension of the end 63 at the position preceding the pair of nip rolls 16 and 17. The monitoring system 84 has an upper displacement gauge 81, a lower displacement gauge 82, and a monitoring device 83.

The upper displacement gauge 81 detects a height position of an upper surface of the filament assembly. The lower displacement gauge 82 detects a height position of a lower surface of the filament assembly. The displacement gauges 81 and 82 are, as an example, non-contact type, and are laser displacement gauges here. As the displacement gauges 81 and 82, for example, a laser displacement gauge "LK-5000" series manufactured by Keyence Corporation can be used. The measurement results of the displacement gauges 81 and 82 are transmitted to the monitoring device 83.

The monitoring device 83 is, for example, a personal computer, and has, in addition to a central processing unit (CPU), a read-only memory (ROM), and a random access memory (RAM), an input unit that receives information to be input by the operator, and a display unit that displays predetermined information to the operator.

Here, when the alignment of the plurality of CA filaments 61 in the filament assembly conveyed in the conveyance direction P is disturbed, the height position of any of the upper surface and the lower surface of the filament assembly fluctuates. The monitoring device 83 calculates the thickness dimension of the filament assembly to be conveyed based on the measurement results of the displacement gauges 81 and 82 at the time of manufacturing the CA tow band 64, and determines whether the calculated thickness dimension of the filament assembly is a value that falls within the allowable range. According to this method, the thickness dimension of the filament assembly is continuously monitored online without sampling the filament assembly being conveyed.

When determining that the thickness dimension of the filament assembly is not a value within the allowable range, the monitoring device 83 causes the display unit to display that the alignment of the plurality of CA filaments 61 in the filament assembly is disturbed, or performs warning processing that emits a warning sound, thereby informing the operator of the same. Based on this warning processing, the operator aligns the plurality of CA filaments 61 in the filament assembly such that the thickness dimension of the filament assembly has a value within the allowable range.

Here, while the value of the allowable range of the thickness dimension of the filament assembly can be set as appropriate, it can be set to a value in which an occurrence of a hole in the filament assembly can be visually recognized by the naked eyes, for example, in planar view of the filament assembly.

The thickness dimension of the filament assembly may be monitored offline by sampling the CA tow band 64 to be conveyed. The displacement gauges 81 and 82 may be arranged to measure the height positions of the upper surface and the lower surface of the CA tow band 64 having passed through the drying device 11 before packing the CA tow band 64 into the packaging container 19 using the transfer machine 85.

Thus, the CA tow band 64 is manufactured using the CA tow band manufacturing device 1. This method for manufacturing has the aligning step, the crimping step, and the monitoring step as follows. The aligning step is a step of aligning the plurality of CA filaments 61 (ends 63) in the roll width direction of the pair of nip rolls 16 and 17 at the position preceding the pair of nip rolls 16 and 17, while conveying the plurality of CA filaments 61 of which the TD is set to a value in the range of 10000 to 40000 (inclusive) and the FD is set to a value in the range of 6.0 to 20.0 (inclusive).

Specifically, the aligning step is performed, for example, by adjusting the positions of the guide pins 7 and 8 that guide the plurality of CA filaments 61 (ends 63) to be conveyed.

The crimping step is a step of crimping, by the pair of nip rolls 16 and 17, the plurality of CA filaments 61 (ends 63) aligned in the aligning step. The monitoring step is a step of monitoring the thickness dimension of the filament assembly consisting of the plurality of CA filaments 61 at at least any of the position preceding the pair of nip rolls 16 and 17 and the position subsequent to the pair of nip rolls 16 and 17. In the monitoring step, the monitoring system 84 is used.

When manufacturing the CA tow band 64 having a relatively small TD and a relatively large FD, an attempt made to crimp the plurality of CA filaments 61 included in the end 63 by the pair of nip rolls 16 and 17 increases an external force (nip pressure) necessary to crimp the plurality of CA filaments 61. Along with this, the CA filaments 61 may be damaged to generate a fragment. In this case, there is a possibility that the strength such as a tensile strength of the CA filaments 61 is reduced. This may result in an occurrence of a failure such as cutting the CA filaments 61 while being conveyed.

Here, the inventor's examination revealed the following. As the number of overlaps of the plurality of CA filaments 61 in the gap between the pair of nip rolls 16 and 17 increases and as the CA filament 61 becomes thicker, the nip pressure necessary for crimping the plurality of CA filaments 61 included in the end 63 increases (in other words, the moment of inertia of area of the end 63, which is an assembly of the plurality of CA filaments 61 increases).

Therefore, in the present embodiment, the crimping step is performed using the pair of nip rolls 16 and 17 of which the ratio TD/D is set to 800 deniers/mm to 2000 deniers/mm (inclusive), where the total denier of the plurality of CA filaments 61 is denoted by TD and the roll width dimension of the pair of nip rolls 16 and 17 is denoted by D.

By setting the ratio TD/D in this manner, the plurality of CA filaments 61 are uniformly aligned in the roll width direction of the pair of nip rolls 16 and 17 and crimped by an external force of an appropriate strength, and the CA tow band 64 can thus be manufactured. This can prevent the CA filament 61 from being fragmented due to an excessive external force applied to the CA filament 61 when the CA filament 61 is crimped.

That is, by setting the ratio TD/D as described above, the plurality of CA filaments 61 are aligned while being widely distributed in the roll width direction of the pair of nip rolls 16 and 17, and the overlaps of the plurality of CA filaments 61 in the gap between the pair of nip rolls 16 and 17 is reduced and uniformed. This uniformly thins the thickness dimension of the end 63 in the roll width direction.

Therefore, even when the CA filament 61 is thick, the plurality of CA filaments 61 can be crimped by a relatively small nip pressure, and it is possible to prevent the CA filament 61 from being fragmented due to an excessive external force applied to the CA filament 61.

In addition, by preventing the CA filament 61 from being fragmented, a high breaking strength of the CA filament 61 can be maintained. For this reason, it is also possible to prevent the CA filament 61 from being fragmented due to an external force applied to the crimped CA filament 61 being conveyed, for example. Therefore, as described later, shaping the CA tow band 64 in a rod allows a tip 67 to be manufactured well and allows the manufacturing efficiency and the quality of the tip 67 to be prevented from decreasing.

Note that the "breaking strength" mentioned here is a tensile load necessary to break the fiber. It is measured in accordance with Japanese Industrial Standards (JIS) L 1015 "Test methods for man-made staple fibres 8.9 Loop strength", and the load at the time of cutting when the measurement sample is the tow band 64 can be defined as the breaking strength.

Here, in the crimping step of the present embodiment, the pair of nip rolls 16 and 17 of which the ratio TD/D is set to 800 denier/mm to 1300 denier/mm (inclusive) is used. As a result, the plurality of CA filaments 61 are aligned more uniformly in the roll width direction of the pair of nip rolls 16 and 17, and the CA tow band 64 that is more uniformly crimped is obtained.

As shown in FIG. 2, a roll width (axial direction) dimension W2 of the pair of nip rolls 16 and 17 in the present embodiment is set to a value greater than a width dimension W1 of the end 63 introduced to the pair of nip rolls 16 and 17. The roll width dimension W2 is set to a value greater than the width dimension W1 of the end 63 in order to allow the plurality of CA filaments 61 included in the end 63 to spread well in the roll width direction by the aligning step. As an example, the roll width dimension W2 is set to a value greater than the width dimension W1 of the end 63 by several mm or more.

In the present embodiment, by monitoring the thickness dimension of the filament assembly in the monitoring step, for example, when the value of the thickness dimension of the filament assembly fluctuates more than the reference range, the aligning step is performed so that the value of the thickness dimension of the filament assembly falls within the reference range.

With this, it is possible to further prevent the CA filament 61 from being fragmented due to the external force applied to the CA filament 61 when the CA filament 61 is crimped by the pair of nip rolls 16 and 17. Accordingly, it is possible to prevent the manufacturing efficiency of the tip 67 from decreasing and it is possible to prevent the quality of the tip 67 from decreasing.

In the crimping step of another example, the plurality of CA filaments 61 of which the TD is set to a value in the range of 20000 to 40000 (inclusive) and the FD is set to a value in the range of 8.0 to 20.0 (inclusive) is crimped.

In the crimping step of yet another example, the plurality of CA filaments 61 of which the TD is set to a value in the range of 10000 to 20000 (inclusive) and the FD is set to a value in the range of 6.0 to 12.0 (inclusive) is crimped.

[Tip Manufacturing Device]

FIG. 3 is an overall view of a tip manufacturing device 20 according to the embodiment. As shown in FIG. 3, the tip manufacturing device 20 includes a convergence ring 21, a first opening unit 22, a turn baffle 23, a second opening unit 24, a pretension roll pair 25, a first opening roll pair 26, a second opening roll pair 27, a third opening unit 28, a plasticizer attachment device 29, a conveyance roll pair 30, a transport jet 31, a winding tube portion 32, and a cutting device 33. The packaging container 19 of FIG. 3 shows a cross sectional structure.

In the tip manufacturing device 20, the CA tow band 64 raised from the inside of the packaging container 19 is inserted into the convergence ring 21 and then opened in the width direction by pressurized air in the first opening unit 22. Thereafter, the CA tow band 64 is guided by the turn baffle 23.

Next, after opened further in the width direction by the pressurized air in the second opening unit 24, the CA tow band 64 is opened in the conveyance direction of the CA tow band 64 by being sequentially inserted between the pretension roll pair 25, between the first opening roll pair 26, and the second opening roll pair 27.

The CA tow band 64 having passed through between the second opening roll pair 27 is opened further in the width direction by the pressurized air in the third opening unit 28, and then a plasticizer is attached by the plasticizer attachment device 29.

The CA tow band 64 having passed through the plasticizer attachment device 29 is inserted between the conveyance roll pair 30, and then introduced into the transport jet 31 and carried into the winding tube portion 32 by jet air flow.

The winding tube portion 32 includes a funnel 41, a tongue 42, and a garniture 43. The CA tow band 64 carried into the winding tube portion 32 is spirally wound on the funnel 41 and shaped into a rod. As a result, a shaped body (rod) 65 in which the CA tow band 64 is shaped into a rod is formed.

A rolling paper 40 is guided by the tongue 42 towards the shaped body 65. The shaped body 65 is conveyed by the garniture 43, and the rolling paper 40 is wound and fixed around the outer periphery thereof. The cutting device 33 cuts the shaped body 65 at intervals. Thus, a plug 66 is manufactured. By further cutting the plug 66, the tip 67 is manufactured.

Thus, the tip 67 is manufactured using the tip manufacturing device 20. This method for manufacturing includes the shaping step of shaping, into a rod, the CA tow band 64 manufactured by the above-described method by adding a plasticizer to the CA tow band 64.

Here, if the plurality of CA filaments 61 included in the CA tow band 64 are fragmented, for example, the fragment may absorb the plasticizer inside the plasticizer attachment device 29 and may be incorporated inside the shaped body 65. In this case, the CA filaments 61 in the shaped body 65 may be dissolved by the plasticizer contained in the fragment to cause a melt hole.

In the present embodiment, on the other hand, the plurality of CA filaments 61 are appropriately prevented from being fragmented as described above. Due to this, when manufacturing the tip 67, the shaped body 65 can be formed by the CA tow band 64 having been well crimped, while preventing the CA filaments 61 from being fragmented. For this reason, for example, it is possible to prevent a melt hole from occurring due to the fragment of the CA filament 61 absorbing the plasticizer. Accordingly, it is possible to prevent the manufacturing efficiency and the quality of the tip 67 from decreasing.

[Tip for Heated Tobacco Product]

FIG. 4 is a sectional view of a heated tobacco product 50 according to the embodiment. As shown in FIG. 4, the heated tobacco product 50 has an elongated shape and includes a heated tobacco product unit 51 and an aerosol generation article 52. The heated tobacco product unit 51 includes a housing 53, a power supply 54, a display unit 55, a control unit 56, a heating unit 57, and an operation unit 58.

The housing 53 is formed in an elongated shape. The power supply 54, the control unit 56, and the heating unit 57 are housed in the housing 53. The display unit 55 and the operation unit 58 are arranged on an outer surface of the housing 53 (here, a side surface of the housing 53 on the back side of the drawing). The shape of the housing 53 is a straight pipe in which one longitudinal end of the heated tobacco product unit 51 is closed in the present embodiment, but the shape is not limited to this.

The control unit 56 is connected to the power supply 54, the display unit 55, and the heating unit 57 via a wiring 68. The control unit 56 is a one-chip microcomputer as an example, and receives a user's operation input from the operation unit 58. Thus, the control unit 56 controls a power supply circuit of the heated tobacco product unit 51 so as to supply power of the power supply 54 to the heating unit 57 or to shut off the supply of the power to the heating unit 57 at a predetermined timing. The control unit 56 also controls the display unit 55 so as to display predetermined information for the user.

The heating unit 57 heats a base material 70 of the aerosol generation article 52 by the power supplied from the power supply 54. The heating unit 57 has a blade 70*a* that is to be inserted into the base material 70 and heats the base material 70 from the inside by Joule heat. Between the housing 53 and the heating unit 57, a circulation passage 59 is provided for circulating external air towards the base material 70 from a gap between an insertion port 51*a* and the aerosol generation article 52.

The aerosol generation article 52 is inserted into the insertion port 51*a* formed at the other longitudinal end of the heated tobacco product unit 51 when the heated tobacco product 50 is in use. The aerosol generation article 52 has a rod shape and includes the base material 70, a separator pipe 71, an aerosol generation portion 72, the tip 67, and a rolling paper 73. In the aerosol generation article 52, the base material 70, the separator pipe 71, the aerosol generation portion 72, and the tip 67 are arranged in this order from one end to the other end in the longitudinal direction. The rolling paper 73 integrally winds the outer periphery of these elements 66 and 70 to 72.

The base material 70 is arranged at one longitudinal end of the aerosol generation article 52. The base material 70 contains a volatile component that is a tobacco component, and is inserted into the inside of the heated tobacco product unit 51 from the insertion port 51*a* of the heated tobacco product unit 51. The base material 70 generates the volatile component by being heated by the heating unit 57 when the heated tobacco product 50 is in use.

The base material 70 contains a flavoring material that generates the volatile component, such as nicotine. Specifically, the base material 70 preferably contains at least any of a tobacco leaf, a tobacco rib, an expanded tobacco, a homogenized tobacco, and a herb leaf. The base material 70 may also contain a flavoring material other than nicotine.

The separator pipe 71 longitudinally extends along the aerosol generation article 52 and is arranged between the base material 70 and the aerosol generation portion 72, thereby functioning as a separator that separates the base material 70 and the aerosol generation portion 72. Due to this, when the aerosol generation article 52 is inserted inside the heated tobacco product unit 51 via the insertion port 51*a*, the separator pipe 71 prevents the base material 70 from being crushed to some extent where the aerosol generation article 52 is longitudinally compressed and the base material 70 contacts the aerosol generation portion 72.

The separator pipe 71 of the present embodiment is formed in a hollow rod shape. In the hollow portion of the separator pipe 71, the volatile component generated from the base material 70 when the heated tobacco product 50 is in use circulates towards the tip 67.

The aerosol generation portion 72 longitudinally extends along the aerosol generation article 52, and generates an aerosol by cooling and condensing a volatile component from the base material 70 having passed through the separator pipe 71.

The aerosol generation portion 72 is composed of, for example, a band-like sheet wound in a circumferential direction of the aerosol generation article 52 or a band-like sheet in which each fold is finely folded so as to longitudinally extend along the aerosol generation article 52. In the aerosol generation portion 72, a circulation path of the aerosol is formed by the gap of the sheet thus wound or finely folded.

The tip 67 of the present embodiment is manufactured by the tip manufacturing device 20 using the CA tow band 64 manufactured by the CA tow band manufacturing device 1. The tip 67 is arranged at the other longitudinal end of the aerosol generation article 52.

The tip 67 includes the shaped body 65 in which the CA tow band 64 is shaped into a rod, and the rolling paper 40 wound around the peripheral surface of the shaped body 65. The tip 67 is put into the user's lips when the heated tobacco product 50 is in use, and filters the aerosol having passed through the aerosol generation portion 72. Inside the shaped body 65, a capsule in which a liquid containing a flavor component and the like is enclosed may be arranged.

A length dimension of the tip 67 (the dimension of the tip 67 in an insertion direction with respect to the insertion port 51*a* of the heated tobacco product 50) can be set as appropriate, for example, it is set to a value in a range of 4 mm to 35 mm (inclusive) (here 7 mm). The length dimension of the tip 67 can be set to a value in a range where, for example, a lower limit value is any of 4 mm, 7 mm, and 10 mm, and an upper limit value is any of 17 mm, 20 mm, 25 mm, 28 mm, 30 mm, and 35 mm. In another example, the length dimension of the tip 67 is set to a value in a range of 7 mm to 12 mm (inclusive). The circumferential length of the tip 67 can be set as appropriate, and is set to a value in a range of 16.5 mm to 24.5 mm (inclusive), for example.

Here, in the CA tow band 64 forming the shaped body 65, the TD is set to a value in the range of 10000 to 40000 (inclusive), the FD is set to a value in the range of 6.0 to 20.0 (inclusive), and the ratio F/TD is set to a value of 0.0015 N/denier or more.

In another example, in the CA tow band 64 forming the shaped body 65, the TD is set to a value in the range of 20000 to 40000 (inclusive), and the FD is set to a value in the range of 8.0 to 20.0 (inclusive).

In yet another example, in the CA tow band 64 forming the shaped body 65, the TD is set to a value in the range of 10000 to 20000 (inclusive), and the FD is set to a value in the range of 6.0 to 12.0 (inclusive).

When the heated tobacco product 50 is in use, the user inserts the aerosol generation article 52 inside the heated tobacco product unit 51 via the insertion port 51*a*, operates the operation unit 58, and turns on the power of the heated tobacco product unit 51. When a capsule is arranged inside the tip 67, the user crushes the capsule by pressing the side portion of the aerosol generation article 52.

Thus, the control unit 56 controls the power supply circuit so as to heat the heating unit 57 by the power from the power supply 54. After a predetermined time elapses in a state where the heating unit 57 has been heated to a predetermined temperature, the control unit 56 causes the display unit 55 to display to the user that smoking is ready.

The user puts the tip 67 into his/her lips and inhales it, whereby the volatile component, having been heated and volatilized by the heating unit 57, from the base material 70 circulates the separator pipe 71. The volatile component having passed through the separator pipe 71 is cooled and condensed when circulating the gap of the aerosol generation portion 72. This generates an aerosol (droplet) containing the volatile component.

The aerosol having passed through the aerosol generation portion 72 is appropriately filtered by the tip 67 and then inhaled by the user. The aerosol collides with the CA tow band 64 used for the tip 67, whereby the temperature of the aerosol is further lowered so as to be inhaled by the user. In addition, the flavor component in the capsule diffused in the tip 67 by the user crushing the capsule is inhaled by the user together with the aerosol.

Here, in the present embodiment, the shaped body 65 can be formed by the CA tow band 64 well crimped while preventing the CA filament 61 from being fragmented. Accordingly, it is possible to prevent the manufacturing efficiency and the quality of the tip 67 from decreasing. Using the aerosol generation article 52 having the tip 67 manufactured with a stable quality, the user can inhale well the heated tobacco product 50, for example, while preventing the fragment of the CA filament 61 from entering the mouth together with the aerosol.

As described above, the CA tow band 64 of the present embodiment is a tow band of cellulose acetate provided by uniting and crimping a plurality of filaments into a bundle, in which the TD is set to a value in the range of 10000 to 40000 (inclusive), the FD is set to a value in the range of 6.0 to 20.0 (inclusive), and the ratio F/TD is set to a value of 0.0015 N/denier or more.

According to this configuration, the strength per the CA filament 61 included in the CA tow band 64 can be improved while setting the TD and the FD of the CA tow band 64 to desired values within the above range. Thus, even if an external force is applied to the CA filament 61 during manufacturing of the CA tow band 64 and the tip 67, the CA filament 61 can be prevented from being fragmented, and hence the tip 67 can be well manufactured. Accordingly, it is possible to prevent the manufacturing efficiency and the quality of the tip 67 from decreasing. Note that although the upper limit value of the ratio F/TD can be set as appropriate, for example, 0.01 N/denier or less is desirable.

(Confirmation Test)

Next, a confirmation test will be described but the present invention is not limited to the examples shown below.

Based on the method for manufacturing the CA tow band 64 of Embodiment 1, the CA tow bands 64 of Examples 1 to 4 set to the values of the FD and the TD shown in Table 1 were manufactured. At the time of manufacturing the CA tow bands 64 of Examples 1 to 4, the monitoring step was performed with the ratio TD/D being set to the values shown in Table 1. This monitoring step was performed at a position preceding the pair of nip rolls 16 and 17 and at a position preceding the position where a presence of a hole of the filament assembly (end 63) described later was confirmed.

Based on the same method for manufacturing as the method for manufacturing the CA tow band 64 of Embodiment 1 except that the monitoring step was omitted, the CA tow bands 64 of Comparative Examples 1 and 2 set to the values of the FD and the TD shown in Table 1 were manufactured. Based on the same method for manufacturing as the method for manufacturing the CA tow band 64 of Embodiment 1 except that the monitoring step was only partially performed by visually monitoring only the alignment of the CA filaments 61, the CA tow bands 64 of Comparative Examples 3 and 4 set to the values of the FD and the TD shown in Table 1 were manufactured. A width dimensions D of the nip rolls used in manufacturing the CA tow bands of Examples 1 to 4 and Comparative Examples 1 to 4 and the TD/D were set to the values shown in Table 1.

The breaking strength F and the ratio F/TD of Examples 1 to 4 and Comparative Examples 1 to 4 were measured, and the presence of the hole of the filament assembly (end) to be conveyed to the position preceding the pair of nip rolls in the conveyance direction was visually confirmed. The results are shown in Table 1.

Using the CA tow bands of Examples 1 to 4 and Comparative Examples 1 to 4, a tip for heated tobacco product electronic cigarette was manufactured by the tip manufacturing device 20 (winding machine "KDF-2" manufactured by Hauni). At this time, the pressure of the pretension roll pair 25 was set to 0.5 bar, and the pressure of the first opening roll pair 26 and the second opening roll pair 27 was set to 1.8 bar. A speed ratio V2/V1 between a rotational speed V1 of the first opening roll pair 26 and a rotational speed V2 of the second opening roll pair 27 was set to 1.4, and a speed ratio V3/V2 between the rotational speed V2 of the second opening roll pair 27 and a rotational speed V3 of the conveyance roll pair 30 was set to 1.48.

In Example 1 and Comparative Examples 1 and 3, the circumferential length of the tip was set to 22.5 mm, and the amount of the CA tow band packed into the tip (net tow weight) was set to 0.47 g/rod. In Example 3, the circumferential length of the tip was set to 16.5 mm, and the amount of the CA tow band packed into the tip (net tow weight) was set to 0.30 g/rod.

The length dimension of the plug (rod) in the middle of manufacturing of Examples 1 and 3 and Comparative Examples 1 and 3 was set to 120 mm. The length dimension of the shaped body in the tip of Example 1 and Comparative Examples 1 and 3 was set to 7 mm, and the length dimension of the shaped body in the tip of Example 3 was set to 8 mm.

In manufacturing the tips of Examples 1 and 3 and Comparative Examples 1 and 3, a plasticizer (glycerin triacetate) corresponding to 7 wt % of the total weight of the CA tow band immediately after spraying the plasticizer onto the surface of the CA tow band in the tip manufacturing device 20 was uniformly attached by spraying using the plasticizer attachment device 29. The amount of generation of fly per 15 minutes generated during the manufacturing of this tip was measured. In the measurement of the amount of generation of fly, the fly remaining inside the box containing the first opening roll pair 26 and the second opening roll pair 27 was collected by an air sucker and weighed by a balance.

A remaining portion of "HeatStick" (registered trademark), which is an aerosol generation article for "iQOS" manufactured by Philip Morris International, from which a tip was removed was connected to the tip of each of Example 1 and Comparative Examples 1 and 3, and thus the aerosol generation article of each of Example 1 and Comparative Example 1 was produced. A remaining portion of "NeoStick" (registered trademark), which is an aerosol generation article for "glo" manufactured by British American Tobacco p.l.c., from which a tip was removed was connected to the tip of Example 3, and thus the aerosol generation article of Example 3 was produced.

Using the aerosol generation articles of each of Examples 1 and 3 and Comparative Examples 1 and 3 having been produced, the PD of each of the tips was measured using "QTM", which is a filter plug measuring device (automatic airflow resistance measuring device) manufactured by Celulean Moreover, an appearance abnormality of the tips of each of Examples 1 and 3 and Comparative Examples 1 and 3 was visually confirmed. The results are shown in Table 1. Note that in Table 1, the amount of generation of fly of Examples 2 and 4 and Comparative Examples 2 and 4 indicates the amount of visually confirmed fly generated during the manufacturing of the CA tow band 64.

TABLE 1

| | Comparative Example 1 | Comparative Example 2 | Comparative Example 3 | Comparative Example 4 | Example 1 | Example 2 | Example 3 | Example 4 |
|---|---|---|---|---|---|---|---|---|
| FD | 12 | 20 | 12 | 12 | 12 | 12 | 9 | 20 |
| TD | 20000 | 20000 | 20000 | 20000 | 20000 | 25000 | 12000 | 25000 |
| Monitoring step | absent | absent | partially performed | partially performed | present | present | present | present |
| Width dimensions D of nip roll (mm) | 12 | 20 | 10 | 25 | 20 | 20 | 15 | 20 |
| TD/D (denier/mm) | 1666 | 1000 | 1000 | 800 | 1000 | 1250 | 800 | 1250 |
| Breaking strength F(N) | 25 | 29 | 20 | 20 | 42 | 50 | 19 | 38 |
| F/TD (N/denier) | 0.0013 | 0.0014 | 0.0010 | 0.0010 | 0.0021 | 0.0020 | 0.0016 | 0.0015 |
| Hole in filament assembly | absent | present | absent | present | absent | absent | absent | absent |
| Amount of generation of fly (mg/15 min) | Large (260) | Small | Large | Small | Small (30) | Small | Small (60) | Small |
| PD of tip (mmWG) | 80 | | 80 | | 85 | | 285 | |
| Visual appearance abnormality of tip | present (melt hole occurred) | | present (melt hole occurred) | | absent | | absent | |

As shown in Table 1, in Examples 1 to 4, the ratio F/TD was set to a value of 0.0015 N/denier or more, and it was found that the strength of the CA filament 61 was equal to or greater than the strength of the CA filament of Comparative Examples 1 and 2. In Examples 1 to 4, it was found that there was no hole formation in the filament assembly and the amount of generation of fly was small.

For this reason, it is considered that in Examples 1 to 4, setting the F/TD of the CA tow band 64 to a value of 0.0015 (N/denier) or more enhanced the strength of the CA filament and prevented the CA filament from being fragmented. In the test results of Examples 1 to 4, the F/TD of the CA tow band 64 is set to a value in the range of 0.0015 (N/denier) to 0.0021 (N/denier) (inclusive).

It is considered that in Examples 1 to 4, by performing the monitoring step, the aligning step was properly performed so that the thickness dimensions of the filament assembly became uniform, the CA filament 61 was crimped while preventing the CA filament 61 from being fragmented, and the high breaking strength of the CA filament 61 was maintained.

As one of the reasons that the tip 67 of Example 3 has a higher PD than that of the tip 67 of Example 1, it is considered that the circumferential length of the tip 67 of Example 3 is smaller than the circumferential length of the tip 67 of Example 1.

On the other hand, in Comparative Example 1, the F/TD value was set to a value lower than that in Examples 1 to 4, and it was found that the strength of the CA filament was lower than that in Examples 1 to 4. It was found that, in Comparative Example 1, a greater amount of fly was generated, compared to Examples 1 to 4 and a melt hole of the tip has occurred.

As a cause of this, it is considered that in Comparative Example 1, since the plurality of CA filaments were crimped with a relatively large nip pressure by the pair of nip rolls 16 and 17, the CA filaments were damaged and the tensile strength of the CA filaments decreased. In addition, it is considered that a large amount of fly occurred due to the damage of the CA filaments, and the fly absorbed the plasticizer and incorporated into the tip, resulting in the generation of the melt hole.

Although Comparative Example 2 has the FD having the same value as that of Example 4, it was found that the value of ratio F/TD was lower than that of Example 4 and hole formation occurred in the filament assembly. As a cause of this hole formation, since Comparative Example 2 has the TD and the number of CA filaments each smaller than that in Example 4, it is considered that a bias of the CA filaments occurred in the roll width direction of the pair of nip rolls 16 and 17 in the assembly when the plurality of CA filaments were conveyed at the time of manufacturing the CA tow band. From this, it is presumed that the CA tow band of Comparative Example 2 is crimped non-uniformly.

In Comparative Examples 3 and 4, although only the alignment of the CA filaments 61 was visually monitored, it was found that the value of the ratio FAD was considerably low and the performance was poorer than that of Examples 1 to 4. In Comparative Example 3, the amount of generation of fly was large, and it was confirmed that a melt hole occurred in the tip. In Comparative Example 4, although the amount of generation of fly was small, it was confirmed that a hole formation occurred in the filament assembly.

The present invention is not limited to the above-described embodiment, and the configuration and method can be changed, added, or deleted in a range without departing from the scope of the present invention.

INDUSTRIAL APPLICABILITY

As described above, the present invention has an excellent effect of being capable of preventing the manufacturing efficiency and the quality of a tip for heated tobacco product from decreasing due to generation of a filament fragment when manufacturing the tip for heated tobacco product using a tow band. Accordingly, it is useful to widely apply the present invention to a tow band for heated tobacco product tip, a tip for heated tobacco product, a method for manufacturing a tow band for heated tobacco product tip, and a method for manufacturing a heated tobacco product tip that are capable of exerting the significance of this effect.

REFERENCE SIGNS LIST

16, 17 nip roll
61 CA filament (filament)
64 CA tow band (tow band)
65 shaped body
67 tip
73 rolling paper The invention claim is:

1. A tow band of cellulose acetate, comprising:
a bundle of a plurality of united and crimped filaments, wherein
the tow band is for heated tobacco product tip,
each of the plurality of filaments is a long fiber filament,
a total denier is set to a value in a range of 10000 to 20000 (inclusive) and a filament denier is set to a value in a range of 6.0 to 12.0 (inclusive), and
where the total denier is denoted by TD and a breaking strength of the tow band is denoted by F, a ratio F/TD is set to a value of 0.0015 N/denier or more.

2. A tip comprising:
a shaped body provided by shaping the tow band according to claim 1 into a rod; and
a rolling paper wound around a peripheral surface of the shaped body.

3. The tip according to claim 2, wherein a lower limit of a range of a length of the tip is set to one of 4 mm, 7 mm, and 10 mm, and an upper limit of the range of the length of the tip is set to one of 20 mm, 25 mm, 28 mm, 30 mm, and 35 mm.

4. The tip according to claim 2, wherein the tip is an aerosol filtering element that passes and filters aerosol, which is a volatile component of a tobacco component.

5. The tow band according to claim 1, wherein the ratio F/TD is set to a value of 0.01 N/denier or less.

6. A method for manufacturing a tow band, the method comprising:
an aligning step of aligning a plurality of filaments in a roll width direction of a pair of nip rolls at a position preceding the pair of nip rolls in a conveyance direction of the plurality of filaments while conveying the plurality of filaments of which a total denier is set to a value in a range of 10000 to 40000 (inclusive) and a filament denier is set to a value in a range of 6.0 to 20.0 (inclusive);
a crimping step of crimping, by the pair of nip rolls, the plurality of filaments having been aligned in the aligning step; and
a monitoring step of monitoring a thickness dimension of a filament assembly consisting of the plurality of filaments at least any of the position preceding the pair of nip rolls and a position subsequent to the pair of nip rolls in the conveyance direction,
wherein in the crimping step, the pair of nip rolls of which a ratio TD/D is set to 800 denier/mm to 2000 denier/mm (inclusive) is used, where the total denier is denoted by TD and a roll width dimension of the pair of nip rolls is denoted by D, and
wherein the tow band is for heated tobacco product tip.

7. The method for manufacturing the tow band according to claim 6, wherein in the crimping step, the pair of nip rolls of which the ratio TD/D is set to 800 deniers/mm to 1300 deniers/mm are used.

8. The method for manufacturing the tow band according to claim 7, wherein in the crimping step, the plurality of filaments of which the total denier is set to a value in a range of 20000 to 40000 (inclusive) and the filament denier is set to a value in a range of 8.0 to 20.0 (inclusive) are crimped.

9. The method for manufacturing the tow band according to claim 7, wherein in the crimping step, the plurality of filaments of which the total denier is set to a value in a range of 10000 to 20000 (inclusive) and the filament denier is set to a value in a range of 6.0 to 12.0 (inclusive) are crimped.

10. A method for manufacturing heated tobacco product tip, the method comprising:

a shaping step of shaping, into a rod, the tow band manufactured by the method for manufacturing according to claim 7 by adding a plasticizer to the tow band.

11. The method for manufacturing the tow band according to claim 6, wherein in the crimping step, the plurality of filaments of which the total denier is set to a value in a range of 20000 to 40000 (inclusive) and the filament denier is set to a value in a range of 8.0 to 20.0 (inclusive) are crimped.

12. The method for manufacturing the tow band according to claim 6, wherein in the crimping step, the plurality of filaments of which the total denier is set to a value in a range of 10000 to 20000 (inclusive) and the filament denier is set to a value in a range of 6.0 to 12.0 (inclusive) are crimped.

13. A method for manufacturing a heated tobacco product tip, the method comprising:

a shaping step of shaping, into a rod, the tow band manufactured by the method for manufacturing according to claim 6 by adding a plasticizer to the tow band.

14. A tow band of cellulose acetate, comprising:

a bundle of a plurality of united and crimped filaments; wherein the tow band is for heated tobacco product tip, each of the plurality of filaments is a long fiber filament, the bundle of the plurality of filaments has a total denier set to a value in a range of 10000 to 20000 (inclusive) and a filament denier set to a value in a range of 6.0 to 12.0 (inclusive), and where the total denier is denoted by TD and a breaking strength of the tow band is denoted by F, a ratio F/TD is set to a value of 0.0015 N/denier or more.

* * * * *